US005938794A

United States Patent [19]

Eggers et al.

[11] Patent Number: 5,938,794

[45] Date of Patent: Aug. 17, 1999

[54] METHOD FOR THE DYEING OF YARN FROM A SUPERCRITICAL FLUID

[75] Inventors: Rudolf Eggers, Buxtehude; Joachim von Schnitzler, Hamburg; Kurt Truckenmüller, Heilbronn, all of Germany

[73] Assignee: Amann & Sohne GmbH & Co., Bonnigheim, Germany

[21] Appl. No.: 08/972,650

[22] Filed: Nov. 18, 1997

[30] Foreign Application Priority Data

Dec. 4, 1996 [DE] Germany ..... 196 50 187
Oct. 22, 1997 [DE] Germany ..... 197 46 656

[51] Int. Cl.[6] ..... D06P 1/00; D06P 3/52; D06P 1/90; D06P 1/613

[52] U.S. Cl. ..... 8/475; 8/552; 8/576; 8/580; 8/149.1; 8/155; 8/149.2

[58] Field of Search ..... 8/475, 922, 148, 8/149.1, 149.2, 151.2, 155, 576, 580, 154

[56] References Cited

U.S. PATENT DOCUMENTS 5,250,078 10/1993 Saus et al. ..... 8/475
5,298,032 3/1994 Schlenker et al. ..... 8/475
5,340,614 8/1994 Perman et al. ..... 427/2.24

FOREIGN PATENT DOCUMENTS 19631604 4/1997 Germany .
9409201 4/1994 WIPO .
9418264 8/1994 WIPO .
9714838 4/1997 WIPO .

*Primary Examiner*—Margaret Einsmann
*Attorney, Agent, or Firm*—Proskauer Rose LLP

[57] ABSTRACT

A method for the dyeing of a textile substrate, particularly for the dyeing of a polyester yarn wound upon a bobbin, is described, in which the textile substrate to be dyed is arranged within an autoclave and superfused, respectively perfused, with a supercritical fluid containing at least one dye, whereby an auxiliary fluid is loaded with the at least one dye, whereby the auxiliary fluid in brought into contact with the supercritical fluid and whereby hereafter the textile substrate is perfused, respectively superfused, with the supercritical fluid containing the at least one dye.

37 Claims, 3 Drawing Sheets

METHOD FOR THE DYEING OF YARN FROM A SUPERCRITICAL FLUID

The present invention is directed to a method for the dyeing of textile substrates with the characteristics of the generic part of patent claim 1.

In addition to the classical dyeing in an aqueous system a dyeing method is today described, in which the aqueous system is substituted by a supercritical fluid.

The DE 39 06 724 A describes the general parameters which have to be taken into account when polyester is to be dyed in a supercritical fluid. In example 1 of the DE 39 06 724 the dyeing of a polyester fabric is then described in detail in such a way that this polyester fabric is dyed with a dye combination consisting of three dispersion dyes at a bath ratio of 1:7 in a laboratory dyeing apparatus by using supercritical carbon dioxide. Hereby this DE 39 06 724 A does not disclose the construction of the laboratory dyeing apparatus.

A method with the characteristics of the generic part of patent claim 1 is described in the publication entitled "F ärbung von Polyester in überkritischem $CO_2$" (the dyeing of polyester in supercritical carbon dioxide) in "Chemiefaser/Textilindustrie, 41./93. Jg., February 1991". In this publication a corresponding dyeing autoclave is schematically shown in the FIG. 10, whereby a stirrer is arranged at the bottom side of the autoclave. A tube-like textile carrier on which the polyester fabric to be dyed is wound up is arranged above the stirrer. After the filling of the dyeing autoclave with the supercritical fluid containing the dye, this supercritical dyeing bath is revolved by the stirrer being arranged at the bottom side.

The afore described known dyeing apparatus might certainly make it possible to dye polyester yarns in supercritical fluids in the laboratory scale, but it is however not suitable to dye textile substrates in the industrial scale. This is referred to the fact that, depending on the corresponding color depth, an essential amount of the dye has to be added to the supercritical fluid when the dyeing is to be carried out in the industrial scale, in order to thus adjust the desired color. Moreover, for industrial dyeings it is required to dye a predetermined color by adding one dye or several dyes, which, however, is not possible when the correspondingly used dyeing autoclave is already filled with the supercritical dye bath.

The present invention has the object of dispose a method of the mentioned kind which makes it possible to add an adjustable dye amount to the supercritical fluid being used for the dyeing within a very short time period.

This object is realized according to the invention by a method with the significant characteristics of patent claim 1.

In the inventive method for the dyeing of a textile substrate, particularly for the dyeing of polyester yarn wound up on a at least one bobbin, the textile substrate to be dyed is firstly arranged within an autoclave. In the autoclave the substrate to be dyed is then perfused, respectively superfused, with a supercritical fluid containing at least one dye. In order to load the supercritical fluid used in the inventive method with the corresponding dye, respectively with the dye combination, by means of which the dyeing is to be carried out, the inventive method provides that firstly the corresponding dye, respectively the dye combination, is added to an auxiliary fluid. Subsequently the auxiliary fluid containing the dye, respectively the dye combination, is brought into contact with the supercritical fluid used in the inventive method, so that hereafter the textile substrate is perfused, respectively superfused, with the supercritical fluid containing the at least one dye.

In this way it is possible to obtain within a very short period of time a sufficient and particularly a maximum loading of the supercritical fluid used for the dyeing with the dye, respectively the dye combination, in a very simple manner.

In the present application the term dye means not only one single dye but also a mixture of dyes, whereby such a mixture of dyes generally consisting of three to twelve dyes is usually used for the dyeing in practice.

In the present application the term supercritical fluid means all fluids which lay above their critical point, whereby concrete supercritical fluids are indicated in the DE 39 06 724. In the inventive method carbon dioxide is preferably used as supercritical fluid.

The above described inventive method shows a number of further advantages. First of all it is to be noted that, by applying the inventive method, the supercritical fluid, preferably carbon dioxide, used for the dyeing comprises a maximum dye amount, particularly a dye amount which saturates the supercritical fluid. This again leads to the fact that the inventive method essentially contributes to the reduction of the dyeing time of the textile substrate, since hereby a dye depletion of the supercritical fluid does not occur during the perfusion, respectively the superfusion, of the textile substrate to be correspondingly dyed. This is an essential reason why wrong dyeings are avoided by applying the inventive method, whereby again the economical factor and the reproducibility are increased. Conditioned by the fact that in the inventive method the correspondingly used dye is not provided as powder in the supercritical fluid, a clumping or even sintering of the dye cannot occur in the inventive method, so that, depending on the correspondingly selected conditions, the textile substrate to be dyed is perfused, respectively superfused, with a supercritical dyeing bath containing constant but adjustable dye amounts. It is furthermore to be noted that the dyeings obtained according to the inventive method have better fastnesses and that the inventive method generally makes an increased dye yield possible.

In respect to the auxiliary fluid used in the inventive method it is to be noted that each auxiliary fluid can be used that guarantees an impeccable transport of the dye to the contact area with the supercritical fluid. In the inventive method a liquid auxiliary fluid in which the dye is solved is however preferably used, whereby such a dye solution in the liquid auxiliary fluid then mainly guarantees that the supercritical fluid is saturated with the dye after the contact of the supercritical fluid with the liquid auxiliary fluid. Furthermore, by this embodiment of the inventive method the dye amounts to be dosed can be adjusted in a particularly precise and reproducible manner, since herefore it is only necessary to adjust the superfusion rate (revolving rate) of the auxiliary fluid to the superfusion rate of the supercritical fluid at the mixing point.

In order to avoid a segregation of the auxiliary fluid and the supercritical fluid and in order to facilitate the dye transfer from the auxiliary fluid to the supercritical fluid, a further development of the inventive method provides that such an auxiliary fluid is selected that is soluble in the supercritical fluid.

In the inventive method it is also possible to select such an auxiliary fluid which can be dispersed or emulsified, preferably in a monodispersal form, in the used supercritical fluid.

In the inventive method it is surely possible to substitute the afore mentioned auxiliary fluid also by an auxiliary fluid mixture, whereby such an auxiliary fluid mixture is preferred when several dyes are used which are differently well soluble in the corresponding auxiliary fluids of the auxiliary fluid mixture.

The above used term solution of the dye in the supercritical fluid means preferably a real solution, but this term also has to cover dye emulsions and dye dispersions in the auxiliary fluid.

It is particularly advantageous when as auxiliary fluid a natural and/or a synthetical oil is chosen for the inventive method. Such natural and/or synthetical oils show, on one hand, the advantage of usually being able to solve a multitude of dyes having a different chemical construction, as particularly also dispersion dyes, whereby the dye transfer from the oily auxiliary fluid to the supercritical fluid is essentially improved. On the other hand, these oily auxiliary fluids are generally inert in comparison with a multitude of supercritical fluids, particularly also in comparison with supercritical carbon dioxide, so that no undesired modifications of the auxiliary fluid occur during the inventive method.

Liquid polyalkylen oxides, preferably ethoxylized polyethlyenglycols and/or ethoxylized polypropylenglycols proved to be particularly suitable for the application as auxiliary fluid in the inventive method. Particularly if such polyalkylen oxides have a medium molecular weight of between about 200 and about 2,000, preferably between about 600 and 1,200, it is highly guaranteed that such oily auxiliary fluids still have a sufficient stability after several uses.

In respect to the dye transfer from the auxiliary fluid to the supercritical fluid it is particularly suitable to mix the liquid auxiliary fluid containing the at least one dye with the supercritical fluid in a two-component nozzle. Particularly if the flow speeds of the fluids to be brought into contact with each other and thus to be mixed, meaning the flow speeds of the auxiliary fluid as well as of the supercritical fluid, are selected in such a way that a high turbulence occurs during the mixing, a maximum saturation of the supercritical fluid with the dye can be obtained under the correspondingly chosen conditions (temperature, pressure and kind of the supercritical fluid).

In respect to the temperature at which the auxiliary fluid is brought into contact and preferably mixed with the supercritical fluid, it is to be noted that a particularly rapid dye transfer from the auxiliary fluid to the supercritical fluid takes place when this temperature, particularly the mixing temperature, lays between 100° C. and 170° C., preferably between 120° C. and 160° C.

The inventive method basically provides two options to remove the auxiliary fluid which is necessary for the transport of the dye to the supercritical fluid.

In the case that the auxiliary fluid does not negatively influence the actual dye procedure of the textile substrate it is advisable to leave this auxiliary fluid in the supercritical fluid until the end of the actual dyeing procedure. This means however that, by adding the dye, the supercritical fluid flowing through the autoclave and through the textile substrate to be dyed is enriched with the auxiliary fluid to be required herefore, so that with an increasing dyeing time also an increasing auxiliary fluid amount exists in the supercritical fluid. This variant of the inventive method is preferably applied for such dyeings which are to be carried out with light or medium color shades and/or in which the auxiliary fluid correspondingly used shows such a good solubility for the dye that only little auxiliary fluid amounts are necessary for the dyeing, in order to add the dye amount required for the dyeing to the supercritical fluid.

In another variant of the inventive method the auxiliary fluid existing in the supercritical fluid is partially or essentially removed from the supercritical fluid during and particularly after the absorption of the dye on the textile substrate to be dyed. This variant of the inventive method is always applied when the solubility of the correspondingly used dye in the auxiliary fluid is relatively low and when dark color shades are to be generated according to the inventive method, meaning when in this case the auxiliary fluid has to provide a relatively large amount of dyes for the used supercritical fluid.

In order to remove in the two above described options of the inventive method the auxiliary fluid existing in the supercritical fluid, it is advisable to separate this auxiliary fluid from the supercritical fluid by reducing the pressure, preferably in a separate arranged separator.

A further embodiment of the inventive method which is preferably used for the dyeing of polyester yarn bobbins, particularly X-bobbins (crosswound packages), provides that in this embodiment of the inventive method a multitude of bobbins containing polyester yarn is arranged within the autoclave, preferably within a cylindrical autoclave, under the formation of at least one bobbin column.

Particularly when two to twenty of the afore mentioned yarn bobbins are arranged within the autoclave under the formation of the bobbin column in such a way that the bobbins are fixed and axially compressed by using a central windupcore, the inventive method makes it possible to transport the supercritical fluid containing the dye in an optimum way to the area of the bobbin column, so that correspondingly to that particularly homogenous dyeing results are obtained. Such a bobbin column is preferably not superfused in a radial manner, as this is known from the aqueous method, but in an axial manner, so that within the autoclave the supercritical fluid containing the dye flows from the lower front face of the lowest bobbin to the upper front face of the top bobbin or vice-versa. Hereby it was surprisingly observed that in the case of such an axial superfusion the dyeing times are essentially reduced, meaning between 20% and 50%, compared with a corresponding radial superfusion, without causing an unhomogeneity.

A further embodiment of the inventive method permits a particularly suitable kind of method, whereby in this embodiment an autoclave is used which takes up only one single bobbin column. The advantage of this variant of the method is that such an autoclave has a relatively small diameter when measured relative to its axial length, so that the manufacturing costs for such an autoclave are correspondingly reduced. It is surely possible to locate several bobbin columns in several cylindrical parallely arranged autoclaves which are at the same moments and/or in different moments superfused with the supercritical fluid containing the dye.

Particularly good dyeing results are obtained in the afore described embodiment of the inventive method if bobbins with a winding height of between 150 mm and 900 mm, preferably between 250 mm and 500 mm, are selected. These bobbins are arranged one above the other under the formation of the afore described bobbin column and then preferably axially superfused according to the inventive method. Hereby the winding height corresponds with the axial length of the bobbin.

In respect to the diameters of the bobbins it is to be noted that these diameters vary preferably between 100 mm and 800 mm, particularly between 200 mm and 400 mm, when the bobbins are axially superfused.

According to the inventive method the yarn wound up on bobbins can be dyed in a particularly economical way when bobbins are used having a winding density varying between 250 g/l and 900 g/l, preferably between 350 g/l and 650 g/l.

As already explained above in connection with the inventive method, in the inventive method the yarn bobbins chosen as textile substrates are preferably axially superfused, which means that the multitude, particularly two to twenty, of the bobbins being arranged one above the other are superfused in such a way that the supercritical bath containing the dye is guided from the lower bobbin front face of the lowest bobbin to the upper bobbin front face of the top bobbin and/or from the upper bobbin front face of the top bobbin to the lower bobbin front face of the lowest bobbin.

In order to facilitate the feeding of the autoclave with the bobbin column in the inventive method and to furthermore guarantee that in the case of an axial superfusion a flowing of the supercritical fluid containing the dye along the outer side of the bobbins is avoided, another embodiment of the inventive method provides that hereby the bobbin column is arranged within a cartridge, whereby the inner jacket surface of the cartridge is located very close to the outer bobbin jacket. This bobbin column enveloped by a corresponding cartridge is then arranged within a cylindrical autoclave in such a way that the outer jacket surface of the cartridge is located close to the inner jacket surface of the autoclave.

Particularly homogenous dyeings can be obtained within a very short time period according to this variant of the inventive method particularly when in the inventive method the bobbins are axially superfused at an empty tube flow speed of between 5 mm/s and 100 mm/s, preferably of between 10 mm/s and 60 mm/s.

In respect to the supercritical fluids described in the initially mentioned prior art, it is to be noted that the inventive method operates with supercritical carbon dioxide preferably when the inventive method is applied for the dyeing of polyester yarns (polyethylenterephthalate) with dispersion dyes. Hereby a dyeing time of between 15 minutes and 150 minutes, a pressure of between 200 bar and 400 bar and a temperature of between 100° C. and 170° C., are preferably chosen.

The inventive method is also suitable for dyeing of polyester sewing yarns wound upon bobbins, particularly in their form of X-bobbins (crosswound packages). Hereby the term sewing yarns means particularly polyester-containing yarns or polyester yarns, whereby such sewing yarns are constructed in the manner which is usual and known for sewing yarns.

Advantageous developments of the inventive method are indicated in the subclaims.

BRIEF DESCRIPTION OF THE DRAWINGS

The inventive method is subsequently explained in detail by an example in connection with the drawing. Hereby the FIGS. 1 to 3 of the drawing show flow charts of devices.

DETAILED DESCRIPTION OF THE DRAWINGS

Figure 1:
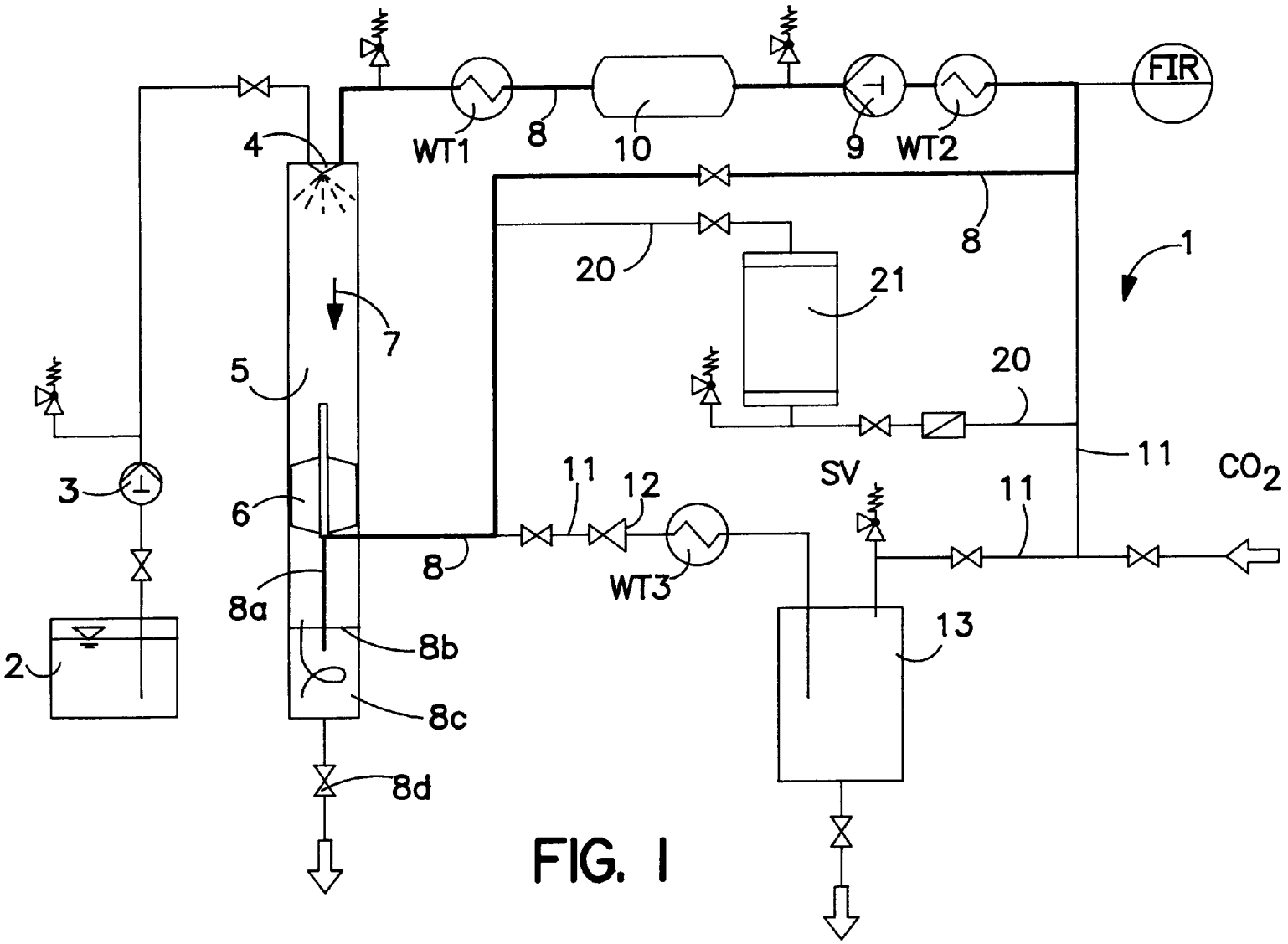

The device totally designated with 1 comprises a preparing vessel 2, whereby the preparing vessel 2 serves to take up the dye absorbed by the auxiliary fluid and preferably solved in the auxiliary fluid. The auxiliary fluid containing the dye is guided from the preparing vessel 2 to a two-component mixing nozzle 4 arranged at the front side of an autoclave 5 by means of a pump 3. A column of yarn bobbins 6 is provided underneath and distantly form the mixing nozzle 4 (FIG. 1), whereby only a single X-bobbin 6 of the yarn bobbin column 6 is shown. Hereby the outer perimeter of the yarn bobbin is adjusted to the inner largeness of the autoclave 5 in such a way that different to the drawing the outer jacket surface of the yarn bobbin 6 contacts the inner jacket surface of the autoclave 5.

The yarn bobbins are axially superfused in the direction of the arrow 7, as this is indicated for example for the yarn bobbin 6 by the arrow 7.

A tube conduct 8 is located underneath and distantly from the bobbin 6. A section 8*a* of the tube conduct 8 extends through a sintered metal plate 8*b* and abuts into a tangential separator 8*c*. The tube conduct 8 extends over corresponding valves, over a heat exchanger WT2, over a piston pump 9, over a buffer vessel 10 and over a heat exchanger WT1 to the mixing nozzle 4. The supercritical fluid used for the corresponding dyeing circulates within this tube conduct 8 (fat signs). This supercritical fluid is mixed with the auxiliary fluid containing the dye in the two-component mixing nozzle 4.

In order to obtain the desired dyeing, the chosen dispersion dye is mixed at 2 with the auxiliary fluid. The correspondingly used supercritical fluid is concurrently fed into the autoclaves as well as into the tube conduct 8, whereby the piston pump 9 effectuates a circulation of the supercritical fluid.

After removing the air from the autoclave by entering the supercritical fluid and after the circulation of the supercritical fluid being effectuated by the pump 9, the auxiliary fluid containing the dye is guided to the mixing nozzle 4 by means of the auxiliary fluid and the pump 3.

The auxiliary fluid containing the dye is thoroughly mixed with the correspondingly chosen supercritical fluid in the mixing nozzle 4, which causes a saturation, respectively an almost complete saturation, of the supercritical fluid with the dyes and the auxiliary fluid. This supercritical fluid containing dyes and the auxiliary fluid then axially superfuses the bobbin 6 in the direction of the arrow 7, so that the dyes are transferred from the supercritical fluid onto the yarn material to be correspondingly dyed.

After the supercritical fluid containing at the bottom side of the bobbins 6 only a small remaining dye amount has axially superfused the bobbins 6, this supercritical fluid is then entered again into the mixing nozzle 4 by means of the conducts 8*a* and 8, in order to be loaded with further dyes and auxiliary fluid.

The device shown in FIG. 1 furthermore comprises a separator bypass, whereby this separator bypass contains the conducts 11, the regulating valve 12, the heat exchanger WT3, a separator 13 and a number of valves (not designated with numbers). Hereby the separator bypass 11 serves to remove the auxiliary fluid, whereby the auxiliary fluid is always removed when it troubles the dyeing or when the concentration of the auxiliary fluid in the supercritical fluid exceeds a given limiting value. Residues of the auxiliary fluid not being solved can also be removed at the bottom side by the tangential separator 8*c* by means of a draining valve 8*d*.

In order to remove this auxiliary fluid in the separator bypass, the separator bypass is correspondingly arranged in such a way that the corresponding valves are operated in the conduct system 8 and 11. This causes a release of the supercritical fluid by means of the regulating valve 12 in such a way that in the separator 13 the liquid auxiliary fluid separates from the fluid not being anymore supercritical because of its reduced solubility, whereby the fluid not being anymore supercritical is entered again into the conduct system 8 and converted back into the supercritical form by means of the heat exchanger WT2 and the piston pump 9.

In addition to that the device shown in FIG. 1 comprises also an adsorber bypass containing the conducts 20, an adsorber 21 and a number of non-designated valves. By means of this adsorber bypass the residues of the non-absorbed dye are adsorptively removed before the end of the dyeing in such a way that the supercritical fluid coming out of the autoclave is guided by operating the corresponding valves in the tube conduct 8 and the conduct 20 over the adsorber 21 where these residues of non-absorbed dye are removed from the supercritical fluid. Only after these residues of non-absorbed dye have been adsorptively removed, the pressure is reduced and the supercritical fluid is converted into its normal form, so that in this moment the actual dyeing is finished.

Figure 2:
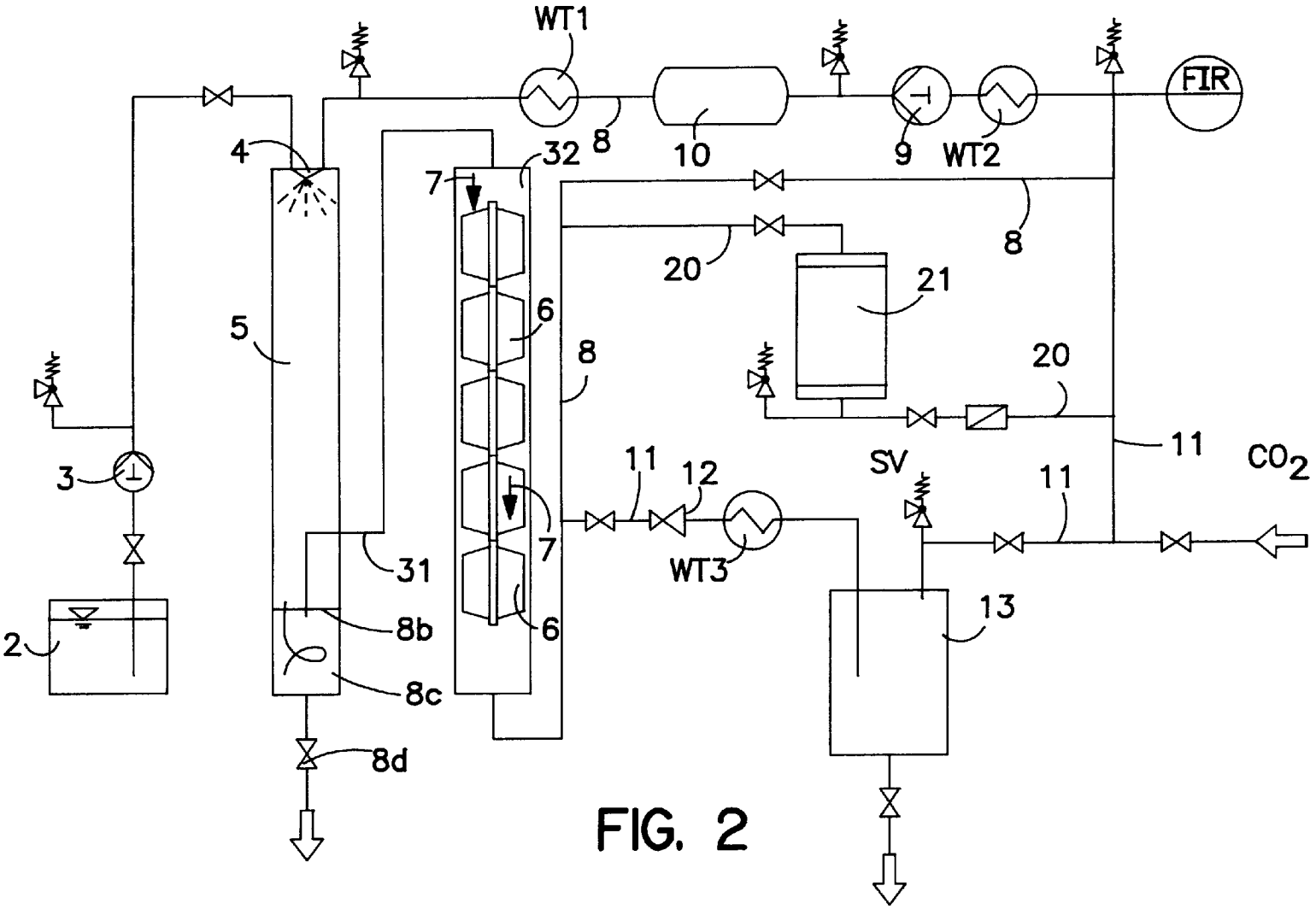
Figure 3:
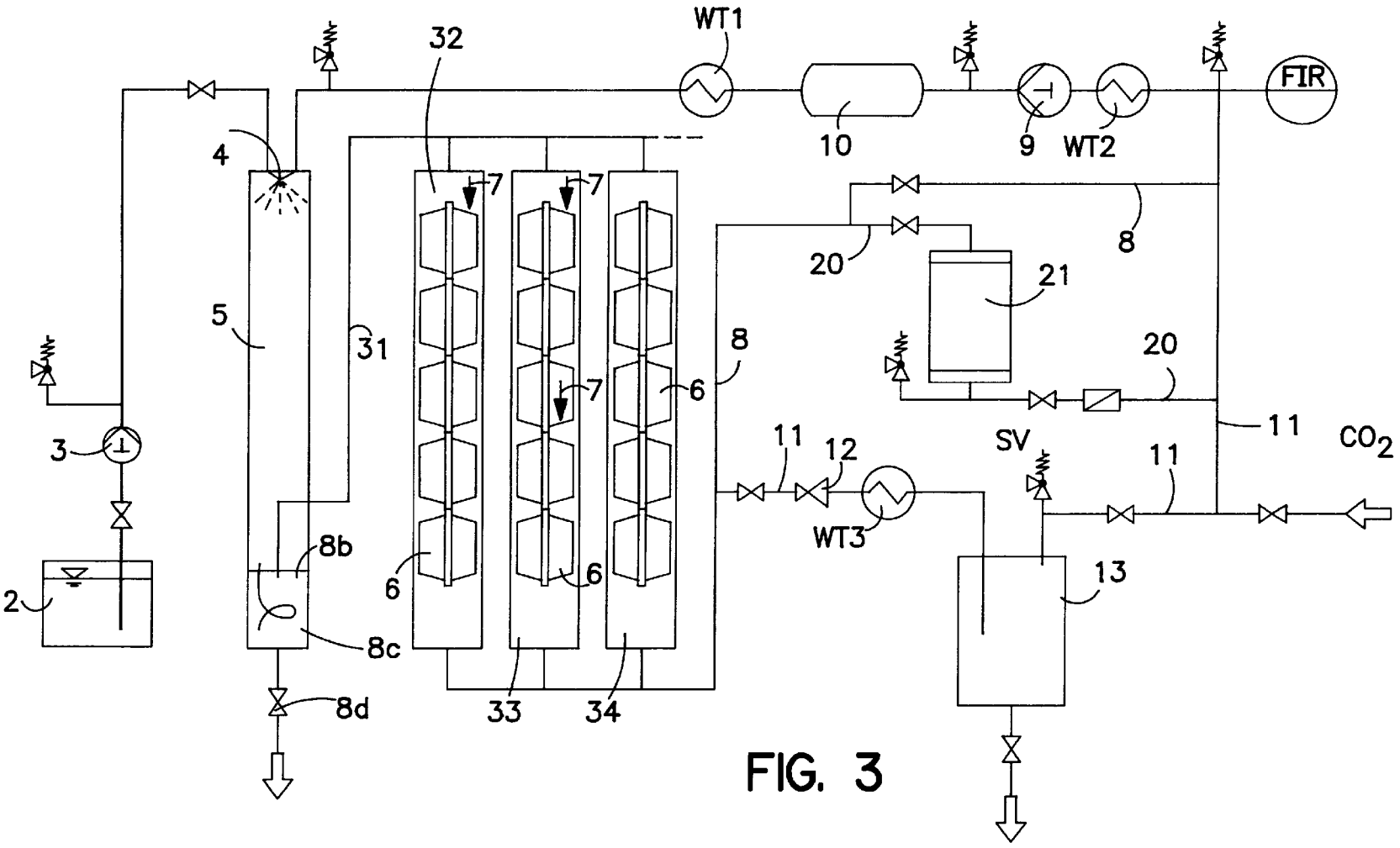

The devices shown in the FIGS. 2 and 3 differ from the afore described device in that way that hereby only the mixing of the supercritical fluid with the auxiliary fluid occurs in the autoclave 5 but not the dyeing, so that this mixture is then entered into one, respectively several, dyeing autoclaves 32, 33 and 34 (FIG. 3) by means of the conduct 31, whereby the columns of the bobbin 6 being axially superfused are then arranged within the dyeing autoclaves 32 to 34. The FIGS. 2 and 3 correspond with the afore described FIG. 1.

On the device schematically shown in FIG. 1 polyester yarn-X-bobbins were dyed, whereby herefore four bobbins 6 being arranged one above the other in the form of a column were located in the autoclave 5.

As supercritical fluid carbon dioxide was used at a pressure of 300 bar and at a temperature of 130° C.

Polypropylenglycol 600 was used as auxiliary fluid, whereby the concentration of the dye, respectively the dyes, correspondingly used in the polypropylenglycol laid at 0.7 g of the dye, respectively the dyes, in 500 g polypropylenglycol.

The dyeing time at final temperature and at final pressure was 45 minutes.

Dyeings of 0.5% were manufactured by using a dye Violett SM1P (manufacturer: Ciba-Geigy) free of floating (auxiliary) agents, a red dye free of floating (auxiliary) agents named Rot SM1P (manufacturer: Ciba-Geigy) and a identical violet-and red-dispersion dye containing floating (auxiliary) agents and being usual in trade.

Moreover, a dyeing of 0.2% was manufactured by using the afore mentioned dyes, both dyes being free of floating agents and both dyes containing floating agents.

The examined fastnesses (friction resistance, wet, dry; water fastness 60° C.; dry heat fixing fastness and light resistance) proved to be impeccable and laid about one or two marks above the indications of the corresponding color card.

We claim:

1. A method for the dyeing of a textile substrate, comprising:

arranging the textile substrate within an autoclave;

loading an auxiliary fluid with at least one dye;

mixing said auxiliary fluid loaded with said at least one dye with a supercritical fluid in a two-component nozzle to form an auxiliary fluid/supercritical fluid mixture and effect at least partial transfer of said at least one dye to said supercritical fluid;

introducing said auxiliary fluid/supercritical fluid mixture exiting said two-component nozzle into said autoclave; and exposing said textile substrate to said auxiliary fluid/supercritical fluid mixture to effect dyeing of said textile substrate.

2. The method according to claim 1, wherein said textile substrate is a polyester yarn.

3. The method according to claim 1, wherein said textile substrate is yarn wound about at least one bobbin.

4. The method according to claim 1, wherein:

said auxiliary fluid is a liquid auxiliary fluid; and said at least one dye is dissolved in said liquid auxiliary fluid.

5. The method according to claim 4, wherein said liquid auxiliary fluid is soluble in said supercritical fluid.

6. The method according to claim 1, wherein said auxiliary fluid is an auxiliary fluid mixture.

7. The method according to claim 1, wherein said auxiliary fluid is a natural oil.

8. The method according to claim 1, wherein said auxiliary fluid is a synthetic oil.

9. The method according to claim 1, wherein said auxiliary fluid is a polyalklen oxide.

10. The method according to claim 9, wherein said auxiliary fluid is an ethoxylized polyethylenglycol.

11. The method according to claim 9, wherein said auxiliary fluid is a polypropylenglycol.

12. The method according to claim 4, wherein said polyester yarn is a sewing yam.

13. The method according to claim 1, wherein said step of mixing of said auxiliary fluid with said supercritical fluid is carried out with high turbulence.

14. The method according to claim 1, wherein said auxiliary fluid is mixed with said supercritical fluid at a temperature of between about 100° C. and about 170° C.

15. The method according to claim 14, wherein said auxiliary fluid is mixed with said supercritical fluid at a temperature of between about 120° C. and about 160° C.

16. The method according to claim 1, further comprising:

separating said supercritical fluid from said auxiliary fluid after the absorption of said at least one dye by the textile substrate.

17. The method according to claim 16, wherein said auxiliary fluid is separated from said supercritical fluid by reducing the pressure in a separately arranged separator.

18. The method according to claim 3, wherein said at least one bobbin includes bobbins arranged within said autoclave under a formation of at least one bobbin column.

19. The method according to claim 18, wherein said autoclave is a cylindrical autoclave.

20. The method according to claim 18, wherein:

said bobbins include about two to about twenty bobbins arranged within said autoclave under the formation of the bobbin column, said bobbins being fixed and axially compressed by a central windupcore; and said supercritical fluid containing said at least one dye axially penetrating said bobbins.

21. The method according to claim 18, wherein bobbin column is a single bobbin column arranged within one autoclave.

22. The method according to claim 18, wherein said bobbins have a winding height of between about 150 mm and about 900 mm.

23. The method according to claim 22, wherein said winding height is between about 250 mm and about 500 mm.

24. The method according to claim 18, wherein said bobbins have a diameter of between about 100 mm and about 800 mm.

25. The method according to claim 18, wherein said diameter is between about 200 mm and about 400 mm.

26. The method according to claim 18, wherein said bobbins have a winding density of between about 250 g/l and about 900 g/l.

27. The method according to claim 26, wherein said winding density is between about 350 g/l and about 650 g/l.

28. The method according to claim 18, wherein said supercritical fluid containing said at least one dye axially penetrates said bobbins from a lower bobbin front face to an upper bobbin front face.

29. The method according to claim 18, wherein said supercritical fluid containing said at least one dye axially penetrates said bobbins from an upper bobbin front face to a lower bobbin front face.

30. The method according to claim 3, wherein:

said at least one bobbin is arranged within a cartridge, an outer bobbin jacket of said at least one bobbin contacting an inner jacket surface of the cartridge; and said cartridge being arranged within the autoclave such that the outer cartridge jacket contacts the inner walling of the autoclave.

31. The method according to claim 18, wherein:

said at least one bobbin column is arranged within a cartridge, an outer bobbin jacket of said bobbins contacting an inner jacket surface of the cartridge; and said cartridge being arranged within the autoclave such that the outer cartridge jacket contacts the inner walling of the autoclave.

32. The method according to claim 3, wherein said supercritical fluid axially penetrates said at least one bobbin during said step of exposing with an empty tube flowing speed of between about 5 mm/s and about 100 mm/s.

33. The method according to plain 32, wherein said empty tube flowing speed is between about 10 mm/s and about 60 mm/s.

34. The method according to claim 1, wherein said supercritical fluid is carbon dioxide.

35. The method according to claim 34, therein:

said textile substrate is a polyester yarn; and said step of exposing is carried out for about 15 minutes to about 150 minutes at a pressure of between about 200 bar and about 400 bar and at a temperature of between about 100° C. and about 170° C.

36. The method according to claim 1, wherein said auxiliary fluid/supercritical fluid mixture perfuses said textile substrate in said step of exposing.

37. The method according to claim 1, wherein said auxiliary fluid/supercritical fluid mixture flows through said textile substrate in said step of exposing.

* * * * *